US007730675B2

(12) United States Patent
Hill

(10) Patent No.: US 7,730,675 B2
(45) Date of Patent: Jun. 8, 2010

(54) POST ANCHOR WITH POST HOLDING IMPRESSIONS

(75) Inventor: Ian A. Hill, Frisco, TX (US)

(73) Assignee: Oz-Post International LLP, Richardson, TX (US)

( * ) Notice: Subject to any disclaimer, the term of this patent is extended or adjusted under 35 U.S.C. 154(b) by 443 days.

(21) Appl. No.: 11/593,438

(22) Filed: Nov. 6, 2006

(65) Prior Publication Data

US 2008/0104899 A1 May 8, 2008

(51) Int. Cl.

| | |
|---|---|
| ***E04H 17/22*** | (2006.01) |
| ***E02D 5/74*** | (2006.01) |
| ***E04B 1/38*** | (2006.01) |
| ***F16M 13/00*** | (2006.01) |

(52) U.S. Cl. ..... 52/153; 52/155; 52/704; 248/530

(58) Field of Classification Search ..... 52/153, 52/154, 155, 165, 170, 298, 704; 135/118; 411/487, 531, 480, 457; 248/156, 545, 903, 248/218.4, 530

See application file for complete search history.

(56) References Cited

U.S. PATENT DOCUMENTS

| | | | | | |
|---|---|---|---|---|---|
| 239,080 | A | * | 3/1881 | Baker | 52/298 |
| 1,031,024 | A | * | 7/1912 | Pickles | 24/713.7 |
| 1,160,458 | A | * | 11/1915 | Smith | 24/580.1 |
| 1,611,935 | A | * | 12/1926 | Mitchell | 52/168 |
| 1,902,875 | A | * | 3/1933 | Mason | 52/103 |
| 2,052,063 | A | * | 8/1936 | Wenn | 411/531 |
| 2,349,110 | A | * | 5/1944 | Potstada | 52/165 |
| 2,438,837 | A | * | 3/1948 | Archer et al. | 72/313 |
| 3,066,447 | A | * | 12/1962 | Reiterer et al. | 47/47 |
| 3,298,646 | A | * | 1/1967 | Van Buren, Jr. | 248/72 |
| 3,342,444 | A | | 9/1967 | Nelson | |
| 3,531,090 | A | | 9/1970 | Liable | |
| 3,544,053 | A | * | 12/1970 | Ingalls | 248/219.3 |
| 3,724,135 | A | * | 4/1973 | Heliotes | 49/504 |
| 3,899,856 | A | * | 8/1975 | Johnson | 52/98 |
| 3,924,373 | A | * | 12/1975 | Lizdas et al. | 52/213 |
| 3,969,853 | A | | 7/1976 | Deike | |
| 3,974,604 | A | * | 8/1976 | Conn et al. | 52/160 |
| 4,021,977 | A | * | 5/1977 | Deike | 52/98 |
| 4,037,418 | A | * | 7/1977 | Hannan | 405/302.1 |
| 4,112,693 | A | * | 9/1978 | Collin et al. | 405/302.1 |
| 4,185,424 | A | * | 1/1980 | Streit | 52/103 |
| 4,227,355 | A | * | 10/1980 | Wendt | 52/64 |

(Continued)

FOREIGN PATENT DOCUMENTS

| | | |
|---|---|---|
| FR | 2 701 504 | 8/1994 |

(Continued)

*Primary Examiner*—Richard E Chilcot, Jr.
*Assistant Examiner*—Andrew J Triggs
(74) *Attorney, Agent, or Firm*—Gardere Wynne Sewell LLP

(57) ABSTRACT

A post anchor includes a ground engaging portion in the form of fins and a post receiving portion that has an oversized top and angled, linear segment or circular impressions below. The impressions form a clamp when downward force is applied to seat the post that is inserted into the post receiving portion. Adjustment in plumb can be made by moving the top of the post to the desired location and inserting hardware at the top edge of the receiving portion. A damaged post can be replaced by removing the hardware, replacing the post and reinserting the connection hardware.

7 Claims, 3 Drawing Sheets

U.S. PATENT DOCUMENTS 4,271,646 A * 6/1981 Mills ..... 52/165
4,279,104 A 7/1981 Classen
4,516,365 A * 5/1985 Chapman ..... 52/170
4,588,157 A * 5/1986 Mills ..... 248/545
4,603,520 A 8/1986 Deike
4,615,156 A 10/1986 Deike
4,780,039 A * 10/1988 Hartman ..... 411/531
4,795,137 A * 1/1989 Witt ..... 256/1
4,831,760 A * 5/1989 Walker ..... 40/620
4,860,940 A * 8/1989 Mills ..... 228/173.4
4,874,149 A * 10/1989 Miceli ..... 248/530
4,923,164 A 5/1990 Stenberg
5,082,231 A * 1/1992 Knowles ..... 248/545
5,085,281 A * 2/1992 Selly ..... 173/91
5,090,656 A * 2/1992 Brown ..... 248/545
5,568,909 A * 10/1996 Timko ..... 248/519
5,632,464 A * 5/1997 Aberle ..... 248/530
5,709,366 A * 1/1998 Speece ..... 248/530
5,722,205 A * 3/1998 Gannaway ..... 52/155
5,915,903 A * 6/1999 Osterle et al. ..... 411/531
5,927,677 A 7/1999 Speece et al.
5,934,855 A * 8/1999 Osterle et al. ..... 411/545
5,951,225 A * 9/1999 Osterle et al. ..... 411/545
6,039,298 A * 3/2000 Stier ..... 248/545
D424,713 S * 5/2000 Blackwell ..... D25/131
D439,437 S * 3/2001 Crete ..... D6/416
6,308,926 B1 * 10/2001 Meyer ..... 248/530
6,340,147 B1 * 1/2002 Dymarczyk ..... 248/530
6,343,446 B1 * 2/2002 Beard ..... 52/165
6,402,115 B1 * 6/2002 Groff et al. ..... 248/508
6,412,235 B1 7/2002 Pylant
6,461,084 B1 * 10/2002 Stuart ..... 405/244
6,497,543 B1 * 12/2002 Lyons ..... 411/171
6,560,935 B1 * 5/2003 Barefield et al. ..... 52/154
6,602,027 B2 * 8/2003 Deaton et al. ..... 408/72 R
6,666,625 B2 * 12/2003 Thornton ..... 405/284
6,745,990 B2 6/2004 Groff et al.
D493,205 S * 7/2004 Combes ..... D21/840
D532,121 S * 11/2006 Watson ..... D25/133
7,134,636 B2 * 11/2006 Callies ..... 248/530
7,152,841 B2 * 12/2006 Callies ..... 248/530
7,185,803 B1 * 3/2007 Lutzke ..... 232/39
7,241,079 B2 * 7/2007 Francis ..... 405/231
D549,853 S * 8/2007 Walker et al. ..... D25/131
2002/0066248 A1 * 6/2002 Buhrts et al. ..... 52/301
2003/0014925 A1 * 1/2003 Cox ..... 52/23
2003/0084620 A1 * 5/2003 Benincasa et al. ..... 52/155
2003/0156905 A1 * 8/2003 Hubert ..... 405/229
2005/0144888 A1 7/2005 Snyders
2005/0252136 A1 * 11/2005 Hardin ..... 52/518
2005/0279896 A1 * 12/2005 Callies ..... 248/218.4
2006/0142402 A1 * 6/2006 Dunnrowicz ..... 521/56
2006/0186306 A1 * 8/2006 Castle ..... 248/544
2008/0016795 A1 * 1/2008 George et al. ..... 52/169.9
2008/0047222 A1 * 2/2008 Barnes ..... 52/693

FOREIGN PATENT DOCUMENTS

GB 2 426 777 12/2006
GB 2 431 938 5/2007

* cited by examiner

POST ANCHOR WITH POST HOLDING IMPRESSIONS

BACKGROUND OF THE INVENTION

1. Technical Field of the Invention

The present invention relates generally to an improved post anchor and in particular to a post anchor having an improved method and system of securing a post to the anchor.

2. Description of Related Art

Posts, such as sign posts, fence posts etc, are typically held in the ground by digging a hole, placing the post in the hole and filling the hole with concrete or firmly compacted soil. This process is effective but time consuming. Furthermore, any impact or heavy wind load on the post can result in post damage which can only be corrected by complete removal of the post and repositioning of a new post following the same procedure.

The problem has been addressed in the prior art by providing post anchors which are decoupled from the post. In the prior art, a number of examples exist of a post anchor which is independently driven into the ground at a location in which a post is to be positioned. The post is then associated with the post anchor by some form of clamping means. Typically, the post anchor is a finned assembly made from pressed mild steel (see, for example, U.S. Pat. Nos. 6,461,084 and 6,560,935, the disclosures of which are hereby incorporated by reference).

In the simplest form, the post is welded to the top of the post anchor once the post anchor has been driven into the ground. Other arrangements have been developed in which a cup is provided at the top of the post anchor into which the post is seated. Fixing arrangements between the cup and the post include bolts and rivets for metal poles or nails for wooden poles. It is also known to provide spikes on the inside wall of the cup to capture wooden poles that are driven into the cup.

Other arrangements include clamping systems to associate the post with the cup. In this solution the post is inserted into the cup and a wedge is driven between the post and the cup to firmly associate the post with the post anchor.

The prior art methods of associating a post with a post anchor have proven to be of limited effectiveness. In particular, the above mentioned styles that have elements extending beyond the confines of the post anchor or the post. These elements can be dangerous to persons and property moving in the vicinity of the post and post anchor. Furthermore, the fastening arrangement is aesthetically unpleasing.

A more suitable manner of securing a post to a post anchor is desirable.

SUMMARY OF THE INVENTION

In one form, although it need not be the only or indeed the broadest form, an embodiment is a post anchor comprising a ground engaging portion comprising two or more fin members, and a post receiving portion comprising of solid or formed and welded cylindrical or square steel that is dimensioned to be larger in size to receive a post to be associated with said post anchor. A post receiving portion has one or more oversized top and angled, linear segment impressions or circular impressions below an upper edge. The impressions form a clamp in the post receiving portion when downward force applied to the top of the post. The ground engaging portion is suitably a stake formed from pressed metal fins that are welded together. The post receiving portion may preferably define a rectangular space to receive correspondingly sized and shaped posts. Alternatively, the receiving portion may define a cylindrical space and the post may have a circular cross section. The post receiving portion may be suitably tapered so as to apply an increasing amount of pressure to the post as it is forced into the post receiving portion opening. The post receiving portion may include holes sized to accept the tip of an adhesive tube dispenser and allow adhesive to be used to anchor the post to the post anchor with or without mechanical hardware. A solid or hollow drive pin or plate is located between adjacent fins and is positioned in alignment with the top edge of the fins. The impressions separate the post from the post receiving portion inner surface so as to produce a void within which adhesive can flow and bond with the post outer surface and the post receiving inner surface.

In an embodiment, a post anchor comprises a ground engaging portion comprising at least one fin member, and a post receiving portion sized and shaped to receive a desired post and including at least one inwardly projecting impression for engaging an outside surface of the desired post when the post is inserted into and received by the post receiving portion.

In another embodiment, a post anchor comprises a ground engaging portion comprising a plurality of fin members, and a post receiving portion comprising tubular member sized and shaped to receive a desired post and including at least one impression inwardly projecting from an interior surface of the tubular member for engaging an outside surface of the desired post when the post is inserted into and received by the post receiving portion.

In yet another embodiment, a post anchor comprises a ground engaging portion comprising a plurality of fin members, and a post receiving portion comprising tubular member and including at least one impression inwardly projecting from an interior surface of the tubular member. The tubular member can have any selected cross-section shape including square, rectangular and circular.

BRIEF DESCRIPTION OF THE DRAWINGS

A more complete understanding of the method and apparatus of the present invention may be acquired by reference to the following Detailed Description when taken in conjunction with the accompanying Drawings wherein.

DETAILED DESCRIPTION OF THE DRAWINGS

Figure 1:
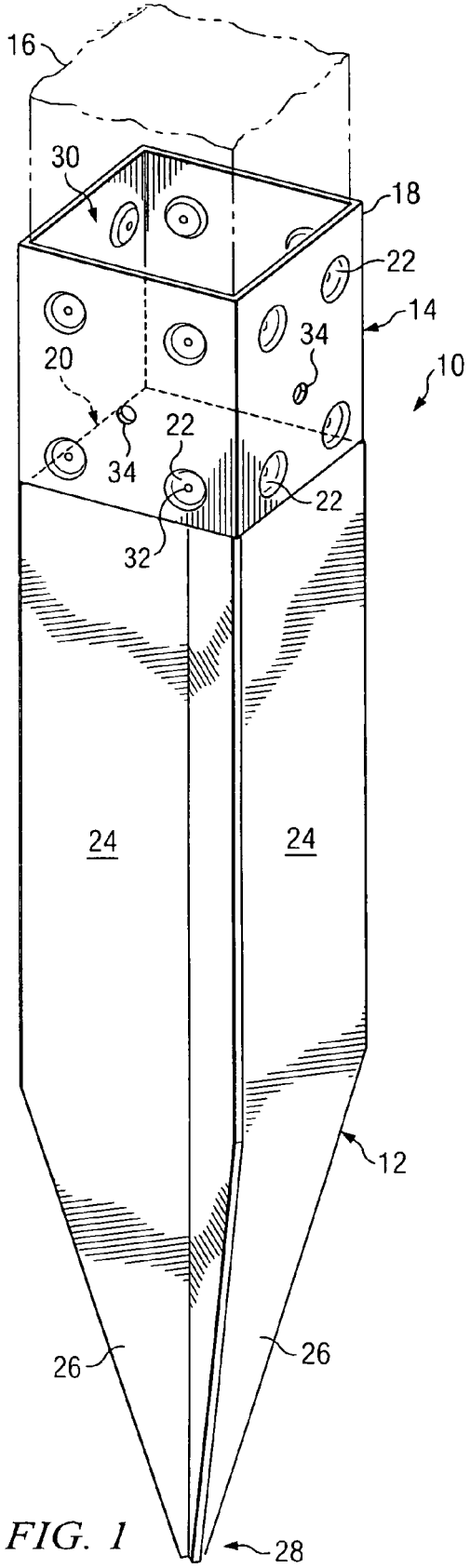
FIG. 1 is a perspective view of a post anchor in accordance with an embodiment of the invention.

In the Drawings, like reference numerals refer to like or similar parts.

With reference to FIG. 1, there is shown a perspective view of a post anchor in 10 accordance with an embodiment of the invention. The post anchor 10 comprises a ground engaging portion 12 and a post receiving portion 14. FIG. 1 illustrates that the post receiving portion 14 has received a post 16. The post 16 may be a sign post, fence post or other similar upstanding member which one desired to secured in and or to the ground. Although the post receiving portion 14 is illustrated as having a generally square cross-section, it will be understood that it may instead have any suitable cross-section complementary to receiving the post 16. In other words, the cross-section of the post receiving portion 14 should have a size and shape which is about the same as (generally slightly larger than) the size and shape of the cross-section of the post 16 which is to be received therein. Examples of other suitable cross-sections for the post receiving portion 14 include rectangular and circular.

As discussed above, the post receiving portion 14 is generally larger, at least at or about a top 18 of the post receiving portion 14, than the post 16 which is to be received. The post 16 is inserted into the slightly larger opening in the post receiving portion 14 at the top 18 and pushed down into the opening in the post receiving portion 14 until the received post 16 is seated at a base 20 of the post receiving portion 14 (or otherwise when further downward advancement of the post 16 is stopped).

The post receiving portion 14 includes a number of inwardly-projecting impressions (or dimples) 22. The term "inwardly" in this context refers to a direction oriented towards an inside of the post receiving portion 14. These impressions 22 engage an outer surface of the post 16 as the post is being inserted into the opening in the post receiving portion 14. These impressions 22 function to resist axial movement of the post 16 with respect to the post anchor 10. In other words, the impressions 22 will resist removal of the post from post receiving portion 14 of the post anchor 10 following insertion. The connection is initiated when the post 16 is inserted into the larger top portion 18. The post 16 will make physical contact with the impressions 22 as the post 16 is forced further into the post receiving portion 14. In some instances, given the clearances involved, the outer surface of the post 16 may be deformed (or otherwise marred or scarred) by the impressions 22 as the post 16 is inserted into the opening on the post receiving portion 14. The impressions 22 are shown in FIG. 1 as having a generally circular shape.

It will be understood that the impressions may have any suitable shape provided sufficient extension in the inwardly direction is provided so as to engage the outer surface of the inserted post 16. The impressions 22 are formed by stamping the desired impression shape (in the illustrated example of FIGS. 1-3 a circular shape) in the sheet metal forming the post receiving portion 14. Because of the stamping process which is used, the inwardly projecting impressions have radiused peripheral edges 33 (best seen in FIGS. 3 and 4) and a contact surface 35. This structure configuration is of some importance because it allows for clamping of the received post 16 to occur without the use of a spike or barb-like structure to physically dig into the post surface. Thus, a secure retention is provided which nonetheless still would permit removal of the post from the anchor if desired. The structure configuration is further advantageous because it obviates the need to use a compressive cap or an inserted wedge to retain the post. Thus, this reduces the parts count needed for an installation.

The ground engaging portion 12 includes a plurality of fins 24. The fins taper at a lower portion 26 thereof to form a point 28 which aids insertion of the ground engaging portion 12 into the ground. Although a finned structure is preferred, it will be appreciated that a solid structure, on indeed a variety of other structures, will be suitable.

Figure 2:
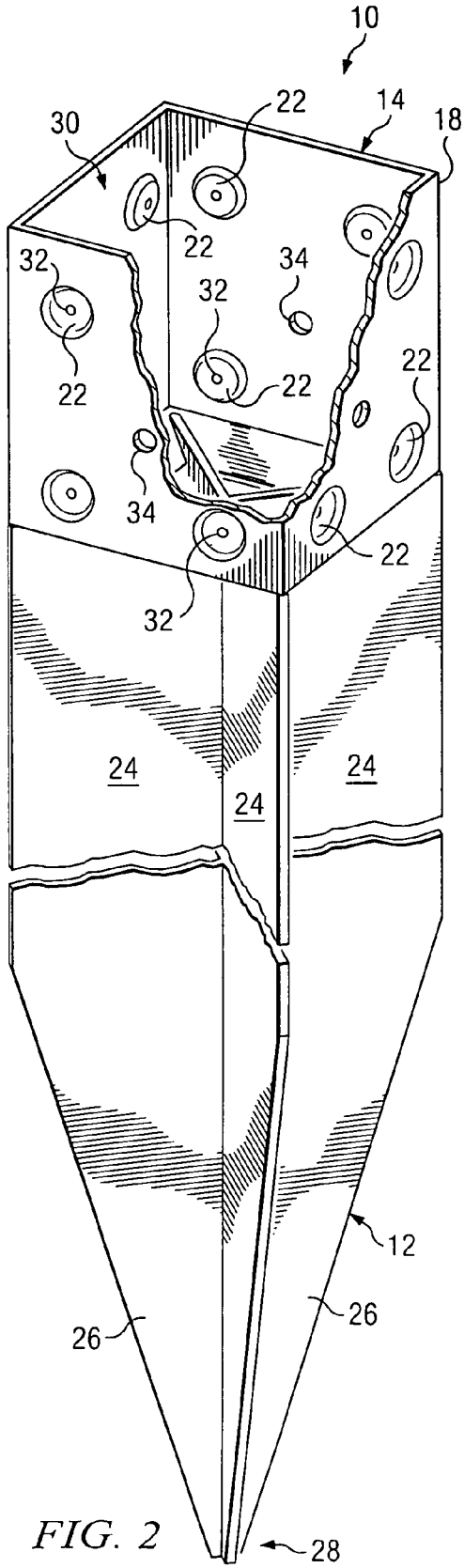
FIG. 2 is a perspective view of the post anchor of FIG. 1 with the post removed and with a portion of the post receiving portion cut-away to reveal interior features and designs.

Reference is now made to FIG. 2 wherein is a perspective view of the post anchor 10 of FIG. 1 with the post 16 removed and with a portion of the post receiving portion 14 cut-away to reveal interior features and designs. FIG. 2 illustrates that a number of impressions 22 are provided, and that these impressions 22 are preferably located on all sides of the post receiving portion 14 and are further provide at a number of positions such that some are located nearer the top 18 while others are located nearer the bottom 20. It will be noted that the location and shape of the impressions 22 can vary. Again, the post receiving portion 14 provides an opening 30 having a size and shape selected to receive a generally correspondingly shaped post 16. The post 16 is thus received by and fits within the opening 30.

An aperture 32 is provided in each impression 22. This aperture is designed to allow for the insertion of a screw there-through, with any such screw engaging a received post 16 so as to further assure retention of the post 16 within the post receiving portion 14. Advantageously, the impression 22 creates a counter-sinking depression on the outer surface of the post receiving portion 14 within which the inserted screw can sit after installation and not protrude (or not protrude as much) out from the outer surface of the post receiving portion 14. Tightening of the inserted screws to engage the post 16 can cause further extension of the impressions 22 in the inwardly direction so as to even more securely engage the outer surface of the received post 16.

Another aperture 34 is provided on one or more sides of the post receiving portion 14. This aperture 34 in one implementation forms a blot/glue port. Through the blot/glue port an installer may inject an adhesive material into the opening 30 of the post receiving portion 14. Preferably, the adhesive is injected through the blot/glue port after the post 16 has been inserted into the opening. In such a case, the injected adhesive will spread to fill the space between the outer surface of the post 16 and the inner surface of the post receiving portion 14 which is formed by the inwardly extending impressions 22. The adhesive, when dried or cured, functions to further assure retention of the post 16 within the post receiving portion 14.

It will be recognized that the aperture 34 may alternatively, or additionally, be used to allow for the insertion of a screw (or bolt) there-through, with any such screw/bolt engaging a received post 16 so as to further assure retention of the post 16 within the post receiving portion 14.

Figure 3:
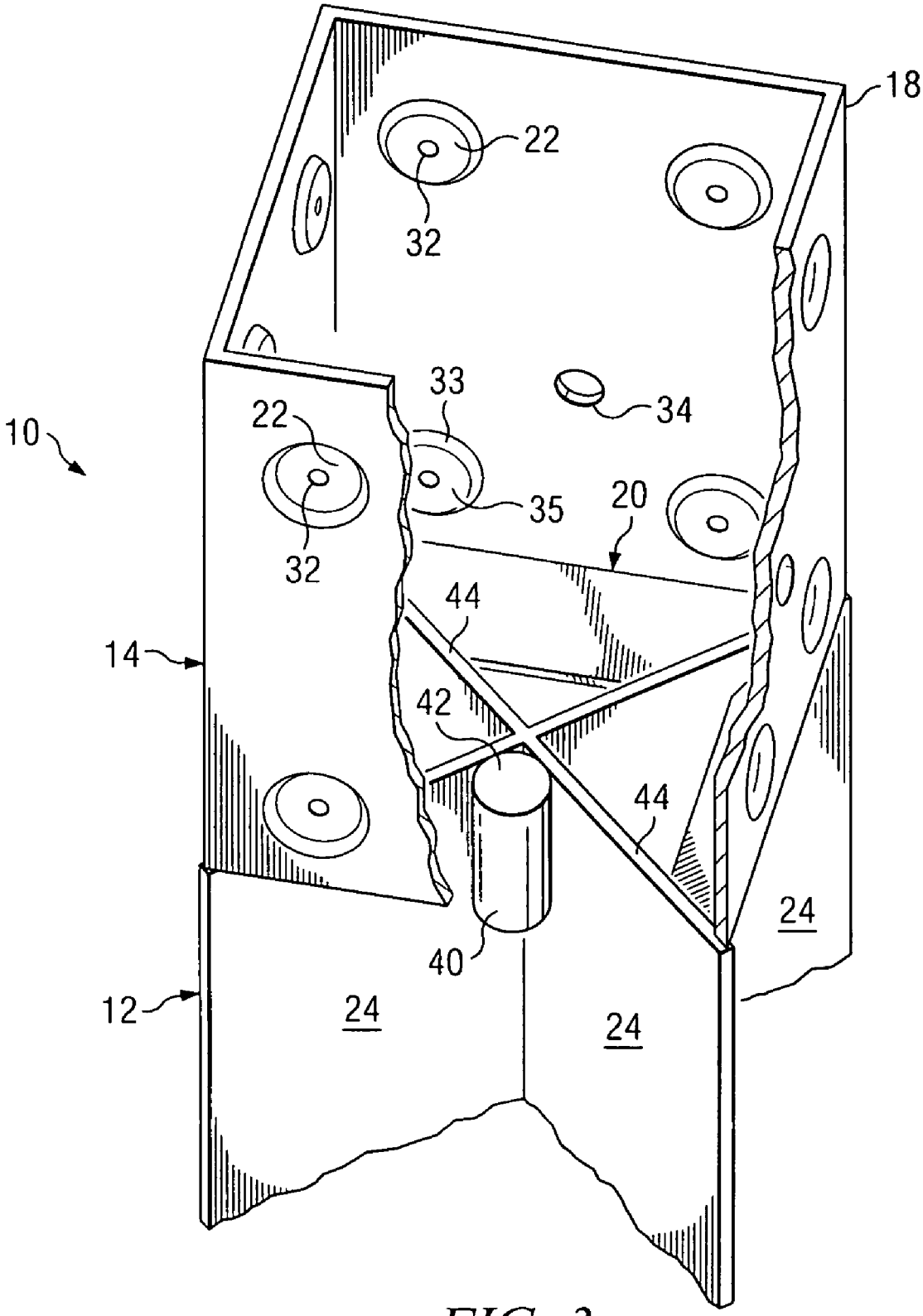
FIG. 3 is a perspective view of the post receiving portion with a portion of the post receiving portion cut-away to reveal interior features and designs.

Reference is now made to FIG. 3 wherein there is shown a perspective view of the post receiving portion 14 with a portion of the post receiving portion cut-away to reveal interior features and designs. A drive pin 40 made of solid round steel bar stock is mounted to the ground engaging portion 12 a corner formed between two adjacent fins 24. A top surface 42 of the drive pin 40 is located flush with the top edge 44 of the fins 24. The drive pin 40 is welded in the corner location preferably near the center of the fin cross section (see, FIG. 4). The drive pin can be made of several profiles and sizes but its location is most preferably flush with the top edge 44 of the fins 24. The drive pin 40 functions to distribute the energy used to drive the post anchor 10 into the ground over a larger area of the fins 24 so as to help minimize damage to the fins 24 caused by operation of the driving tool. More specifically, the drive pin 40 helps to ensure that the fins 24, at or near the top edge 44 are not severely crumpled through the pounding action of the driving tool during installation of the post anchor 10 into the ground. The drive pin 40 further secures the welding seam between the fins 24 at or near the top edge 44. Although solid round bar stock is preferred, in another implementation the drive pin 40 can have a hollow tubular shape. In yet another implementation, the drive pin can instead comprise a plate-like structure drive pin 40' welded to and extending diagonally between two adjacent pins (see, phantom illustration in FIG. 4). Again, a top edge of the drive pin 40' would be located most preferably flush with the top edge 44 of the fins 24.

Figure 4:
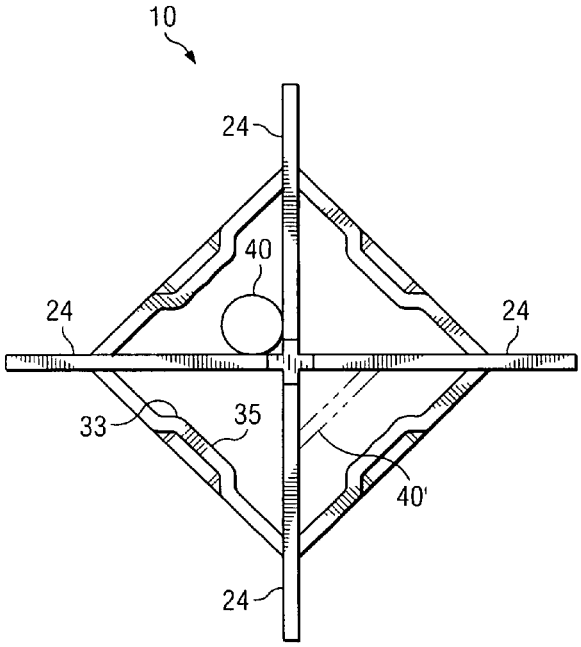
FIG. 4 is a top view of second embodiment of a post anchor in accordance with the present invention.
Figure 5:
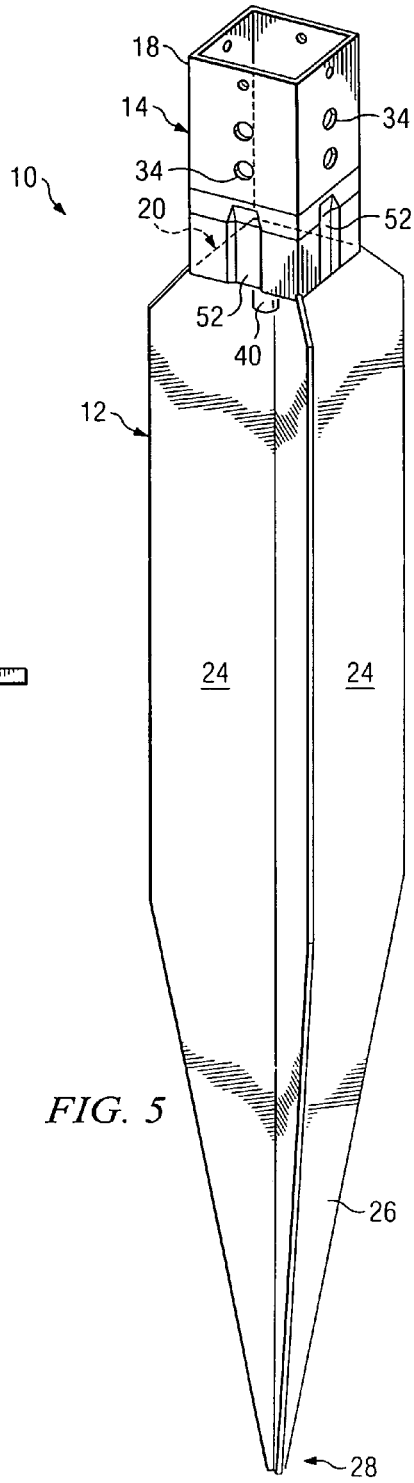
FIG. 5 is a perspective view of the post anchor of FIG. 4 in accordance with the second embodiment of the invention.

Reference is now made to FIGS. 4 and 5 for a discussion of a second embodiment of a post anchor 10 in accordance with the present invention. The second embodiment shares a number of structures and features in common which will not be further described. Reference is made to the discussion above with respect to FIGS. 1-3.

As shown most clearly in FIG. 5, the second embodiment of the post anchor 10 includes an impression structure in the form of an inwardly projecting linear segment impression 52. The linear segment impression 52 is positioned at or near the bottom 20 of the post receiving section 14 and in a preferred implementation is angled such that the amount of inward projection increases in height along the length of the segment impression 52 towards the bottom 20. These impressions 52 engage an outer surface of the post 16 as the post is being inserted into the opening in the post receiving portion 14. More specifically, the angled linear segment impressions 52 form a clamping structure which engages the post 16 more tightly as the post is inserted further into the opening 30. These impressions 52 function to resist axial movement of the post 16 with respect to the post anchor 10. In other words, the impressions 52 will resist removal of the post from post receiving portion 14 of the post anchor 10 following insertion. The connection is initiated when the post 16 is inserted into the larger top portion 18. The post 16 will make physical contact with the impressions 52 as the post 16 is forced further into the post receiving portion 14. In some instances, given the clearances involved, the outer surface of the post 16 may be deformed (or otherwise marred or scarred) by the impressions 52 as the post 16 is inserted into the opening on the post receiving portion 14.

The impressions 52 shown in FIGS. 4 and 5 may have any suitable linear segment shape provided sufficient extension in the inwardly direction is provided so as to engage the outer surface of the inserted post 16. The impressions 52 are formed by stamping the desired impression shape (in the illustrated example of FIGS. 4-5 a linear segment of channel shape) in the sheet metal forming the post receiving portion 14. Because of the stamping process which is used, the inwardly projecting impressions have radiused peripheral edges 33 (see FIG. 4) and a contact surface 35. This structure configuration is of some importance because it allows for clamping of the received post 16 to occur without the use of a spike or barb-like structure to physically dig into the post surface. Thus, a secure retention is provided which nonetheless still would permit removal of the post from the anchor if desired. The structure configuration is further advantageous because it obviates the need to use a compressive cap or an inserted wedge to retain the post. Thus, this reduces the parts count needed for an installation.

The placement of the impressions 52 only at or near the bottom 20 of the post receiving portion 14 assists in installation of the post in a plumb relationship. The impressions engage the lower portion of the post 16 when seated in the opening of the post receiving portion 14. This allows for gaps at or near the top 18 of the post receiving portion 14 to be present. By rocking the post 16 within the post receiving portion 14, adjustments to achieve a plumb installation can be made. Once plumb is established, the apertures 34 can be used for adhesive insertion or screw insertion in order to secure the post in that established plumb position.

The above description has been made in terms of a four fin 24 ground engaging portion 12. The invention is not limited to this situation. In fact, the ground engaging portion 12 may be a single fin or spike. The four fin 24 arrangement, however, is the most suitable in many applications.

It will be appreciated that the post anchor 10 described above provides a secure association of the post 16 to the post anchor 10 by virtue of the impressions 22/52 that make a secure engagement with the post 16. With this design the post receiving portion 14 can be completely or partially buried in the ground so the final appearance is visually pleasing and functionally superior to the prior art. Furthermore, should the post become damaged, it can be replaced by removal of the securing hardware and post. A new post can then be placed into the post receiving portion and forced into the impressions to make a secure engagement with the post.

Although preferred embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A post anchor, comprising:

a ground engaging portion comprising at least one fin member; and a post receiving portion sized and shaped to receive a desired post and including at least one inwardly projecting impression for engaging an outside surface of the desired post when the post is inserted into and received by the post receiving portion, wherein each inwardly projecting impression is defined by a radiused peripheral edge and a flat contact surface surrounded by the radiused peripheral edge;

mounting hardware; and wherein an aperture is provided in each contact surface and is sized and shaped to receive said mounting hardware for securing the post in position within the post receiving portion.

2. The post anchor of claim 1 wherein the impression has a round dimple shape.

3. The post anchor of claim 1 wherein the post receiving portion further includes at least two opposed sides, each of the opposed sides including at least one inwardly projecting impression for engaging opposed outside surfaces of the desired post when the post is inserted into and received by the post receiving portion.

4. The post anchor of claim 1 wherein the hardware comprises a screw.

5. A post anchor, comprising:

a ground engaging portion comprising at least one fin member extending along a length to a point; and a post receiving portion sized and shaped to receive a desired post and including at least one inwardly projecting impression for engaging an outside surface of the desired post when the post is inserted into and received by the post receiving portion, wherein the ground engaging portion comprises at least two fins meeting at a corner and further comprising a drive pin secured to reinforce the two fins wherein the drive pin is a plate extending vertically parallel to the length of the fin member, the vertical plate further extending across the corner between the two fins.

6. A system, comprising:

a post; and a post anchor, comprising:

a ground engaging portion comprising a plurality of fin members; and a post receiving portion comprising tubular member and including a least two opposed surfaces, each opposed surface including at least one impression inwardly projecting from an interior surface of the tubular member, wherein each impression has a round shape having an edge portion and a flat contact surface, and opposed flat contact surfaces from opposed surfaces of the post receiving portion engage opposed post surfaces securing said post within the post receiving portion;

wherein each flat contact surface includes an aperture, and further including securing hardware passing through the aperture of at least one of the flat contact surfaces to further secure said post within the post receiving portion.

7. The system of claim 6 wherein the post receiving portion includes an aperture, and further including an adhesive injected within the port receiving portion through the aperture to further secure said post within the post receiving portion.

* * * * *